US008575465B2

(12) United States Patent
Rao et al.

(10) Patent No.: US 8,575,465 B2
(45) Date of Patent: Nov. 5, 2013

(54) SYSTEM AND METHOD FOR SCORING A SINGING VOICE

(75) Inventors: Preeti Rao, Mumbai (IN); Vishweshwara Rao, Mumbai (IN); Sachin Pant, Mumbai (IN)

(73) Assignee: Indian Institute of Technology, Bombay, Mumbai (IN)

( * ) Notice: Subject to any disclaimer, the term of this patent is extended or adjusted under 35 U.S.C. 154(b) by 63 days.

(21) Appl. No.: 13/322,769

(22) PCT Filed: Jun. 1, 2010

(86) PCT No.: PCT/IN2010/000361

§ 371 (c)(1), (2), (4) Date: Nov. 28, 2011

(87) PCT Pub. No.: WO2010/140166

PCT Pub. Date: Dec. 9, 2010

(65) Prior Publication Data

US 2012/0067196 A1 Mar. 22, 2012

(30) Foreign Application Priority Data

Jun. 2, 2009 (IN) ..... 1338/MUM/2009

(51) Int. Cl.
*A63H 5/00* (2006.01)
*G04B 13/00* (2006.01)

(52) U.S. Cl.
USPC ..... 84/609; 84/610; 84/611; 84/615; 84/649; 84/651; 84/653; 84/477 R

(58) Field of Classification Search
None
See application file for complete search history.

(56) References Cited

U.S. PATENT DOCUMENTS 5,521,324 A * 5/1996 Dannenberg et al. ..... 84/612
5,889,224 A 3/1999 Tanaka (Continued)

FOREIGN PATENT DOCUMENTS

WO WO2005/114648 12/2005
WO WO2006/115387 11/2006
WO WO2008/004641 1/2008

OTHER PUBLICATIONS

International Search Report from the European Patent Office dated Nov. 19, 2010 for International Application No. PCT/IN2010/000361.

(Continued)

*Primary Examiner* — Marlon Fletcher
(74) *Attorney, Agent, or Firm* — Klein, O'Neill & Singh, LLP

(57) ABSTRACT

A system for scoring a singing voice comprises receiving a singing reference audio signal and/or a user audio signal and/or a pitch contour representation (PCR) of the reference and/or user singing audio signals; a processor means connected to the receiving means and comprising a pitch contour representation (PCR) module (10) for determining a PCR of the singing reference and/or user audio signal, a time synchronization module for time synchronizing the PCRs of the reference and user audio signals respectively. A selection module is provided for selecting a segment of the PCRs based on pre-defined criteria. A cross-correlation module is provided for performing time-warped cross-correlation on the selected segments of the PCRs and outputting a cross-correlation score. The system comprises a key matching module and rhythm matching module for key matching and rhythm matching the remaining unselected segments of the PCRs, and outputting a respective key matching score and rhythm matching score, a scoring module (16) for determining a singing score based on a combination of a pre-determined weightage of the cross-correlation, key matching and rhythm matching scores. A user interface means connects the processor for changing at least one module parameter within at least one module; stores and displays the PCR and singing score.

20 Claims, 4 Drawing Sheets

(56) References Cited

U.S. PATENT DOCUMENTS

Figure 1:
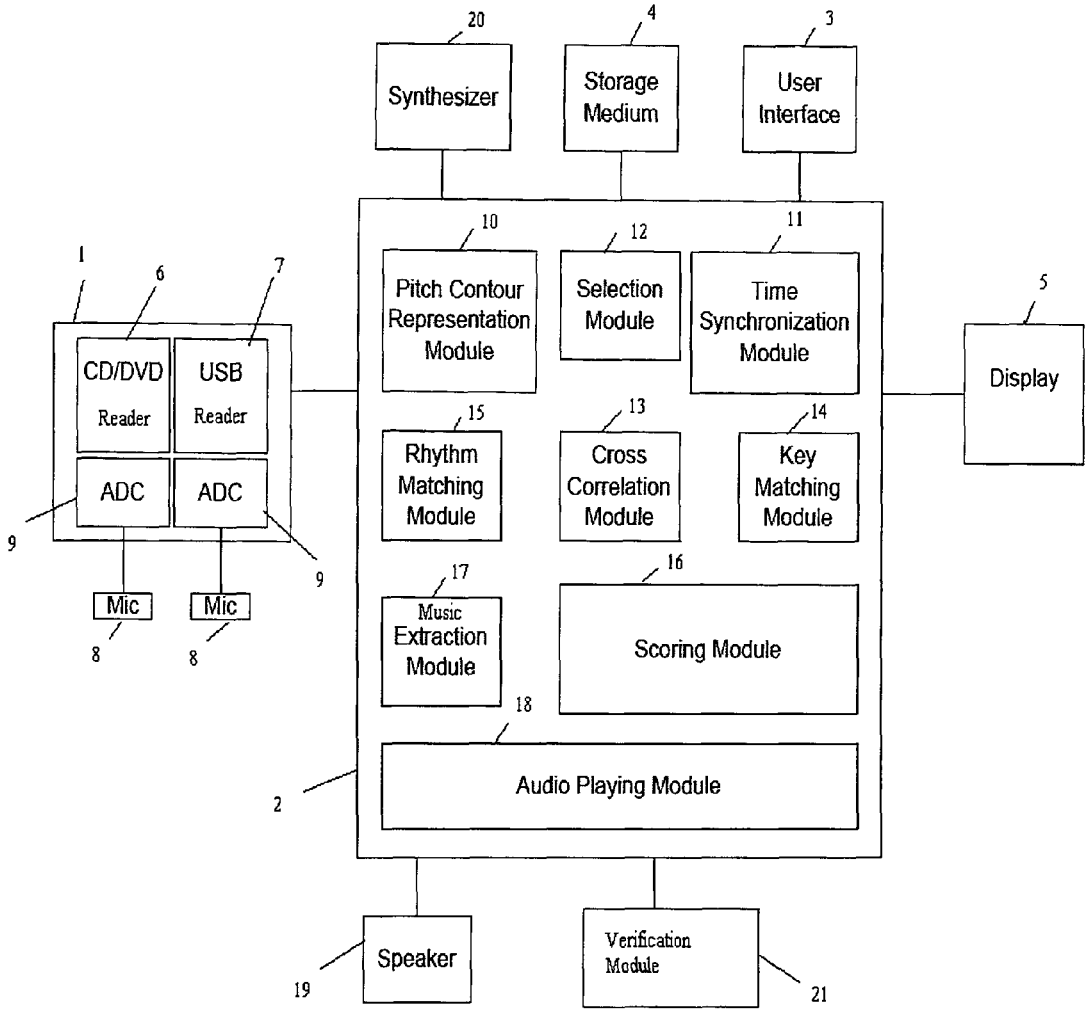

| | | | | |
|---|---|---|---|---|
| 7,321,854 | B2 * | 1/2008 | Sharma et al. | 704/243 |
| 8,290,769 | B2 * | 10/2012 | Taub et al. | 704/207 |
| 2007/0221048 | A1 | 9/2007 | Li | |
| 2009/0038467 | A1 * | 2/2009 | Brennan | 84/609 |
| 2009/0038468 | A1 | 2/2009 | Brennan | |
| 2009/0165634 | A1 | 7/2009 | Mahowald | |
| 2009/0317783 | A1 | 12/2009 | Noguchi | |
| 2010/0169085 | A1 | 7/2010 | Rao et al. | |
| 2010/0192753 | A1 * | 8/2010 | Gao et al. | 84/610 |
| 2010/0212478 | A1 * | 8/2010 | Taub et al. | 84/645 |
| 2010/0233661 | A1 * | 9/2010 | Franzblau | 434/178 |
| 2010/0300264 | A1 * | 12/2010 | Foster | 84/610 |
| 2010/0300268 | A1 * | 12/2010 | Applewhite et al. | 84/610 |
| 2010/0300270 | A1 * | 12/2010 | Applewhite et al. | 84/610 |
| 2010/0319517 | A1 * | 12/2010 | Savo et al. | 84/609 |
| 2011/0004467 | A1 * | 1/2011 | Taub et al. | 704/207 |
| 2012/0297958 | A1 * | 11/2012 | Rassool et al. | 84/609 |
| 2013/0025437 | A1 * | 1/2013 | Serletic et al. | 84/634 |

OTHER PUBLICATIONS

Written Opinion from the European Patent Office dated Nov. 19, 2010 for International Application No. PCT/IN2010/000361.

* cited by examiner

SYSTEM AND METHOD FOR SCORING A SINGING VOICE

CROSS-REFERENCE TO RELATED APPLICATION

This application claims priority, under 35 U.S.C. §371(c), to International Application No. PCT/IN2010/000361, filed on Jun. 1, 2010, the disclosure of which is incorporated herein by reference in its entirety.

FIELD OF THE INVENTION

This invention relates to a system and method for scoring a singing voice.

BACKGROUND OF THE INVENTION

Generally, for scoring a singing voice, it is compared with a reference singing voice. Usually, the reference singing voice is stored in MIDI (Musical Instrument Digital Interface) representation converted manually or automatically from the audio signal containing the singing voice. Therefore, to compare the singing voice with the reference voice, the singing voice is also converted into a MIDI representation either manually or automatically from its corresponding audio signal. The result of such comparison is a numerical value indicating the quantum of exactness of the match between the reference singing voice and the singing voice. The MIDI representation of a singing voice contains only note values and their timing information thereby allowing only note values and duration in the singing voice to be taken into consideration. A comparison based on such parameters is usually coarse and hence does not capture the finer aspects of singing such as musical expressiveness.

OBJECTS OF THE INVENTION

An object of the invention is to provide a system and method for scoring a singing voice wherein the comparison of the singing voice with a reference singing voice is fine and detailed.

Another object of the invention is to provide a system and method for scoring a singing voice wherein the score is a measure of musical expressiveness.

DETAILED DESCRIPTION OF THE INVENTION

According to the invention, there is provided a system for scoring a singing voice, the system comprising a receiving means for receiving a singing reference audio signal and/or a user audio signal and/or a pitch contour representation (PCR) of the reference and/or user singing audio signals; a processor means connected to the receiving means and comprising a pitch contour representation (PCR) module for determining a PCR of the singing reference and/or user audio signal, a time synchronization module for time synchronizing the PCRs of the reference and user audio signals respectively, a selection module for selecting a segment of the PCRs of the reference and user audio signals based on pre-defined criteria, a cross-correlation module for performing time-warped cross-correlation on the selected segments of the PCRs of the reference and user audio signals and outputting a cross-correlation score, a key matching module and rhythm matching module for key matching and rhythm matching the remaining unselected segments of the PCRs of the reference and user audio signals respectively and outputting a respective key matching score and rhythm matching score, a scoring module for determining a singing score based on a combination of a pre-determined weightage of the cross-correlation, key matching and rhythm matching scores; a user interface means connected to the processor means for changing at least one module parameter within at least one module; a storing means connected to the processor means; a display means connected to the processor means for displaying the PCR and singing score;

According to the invention there is also provided a method for scoring a singing voice, the method comprising the steps of receiving a singing reference audio signal and/or a singing user audio signal and/or a pitch contour representation (PCR) of the respective reference and/or user audio signals, determining a pitch contour representation (PCR) of the singing reference audio signal if the PCR thereof not being received, selecting a segment of the PCRs of the reference audio signal based on pre-defined criteria, determining a pitch contour representation (PCR) of the singing user audio signal if the PCR thereof not being received, time-synchronizing the PCRs of the reference and user audio signals, selecting a segment in the user PCR of the user audio signal corresponding to the segments selected in the reference PCR, performing time-warped cross-correlation of the selected segments of the PCRs of the reference and user audio signals and outputting a cross-correlation score, key matching and rhythm matching the remaining unselected segments of the PCRs of reference and user audio signals and outputting a key matching score and rhythm matching score, determining a singing score based on a combination of a pre-determined weightage of the cross-correlation, key matching and rhythm matching scores.

These and other aspects, features and advantages of the invention will be better understood with reference to the following detailed description, accompanying drawings and appended claims, in which, FIG. 1 is a block diagram of a system for scoring a singing voice.

Figure 2:
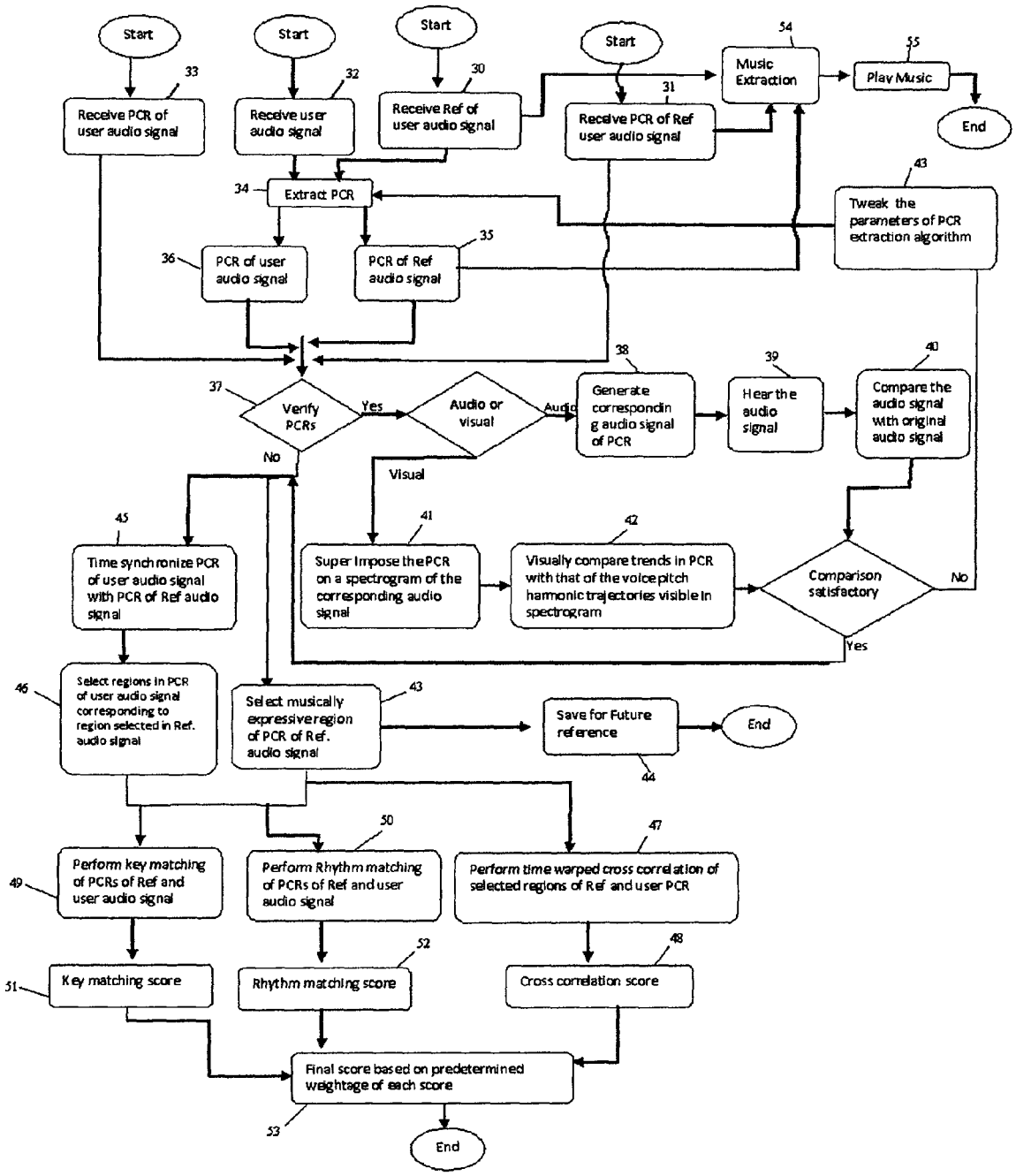

FIG. 2 is a flow chart depicting the steps involved in a method for scoring a singing voice.

Figure 3A:
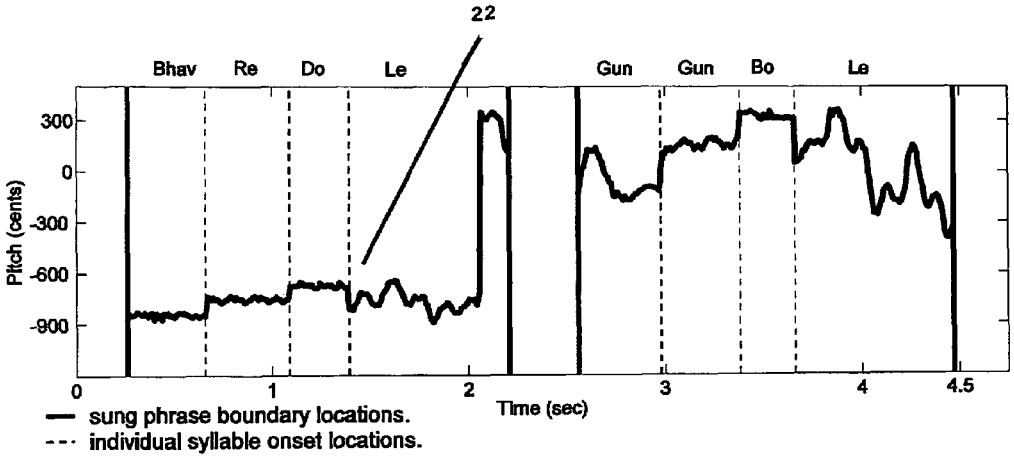

FIG. 3*a* is a Pitch Contour Representation (PCR) of a singing voice with errors.

Figure 3B:
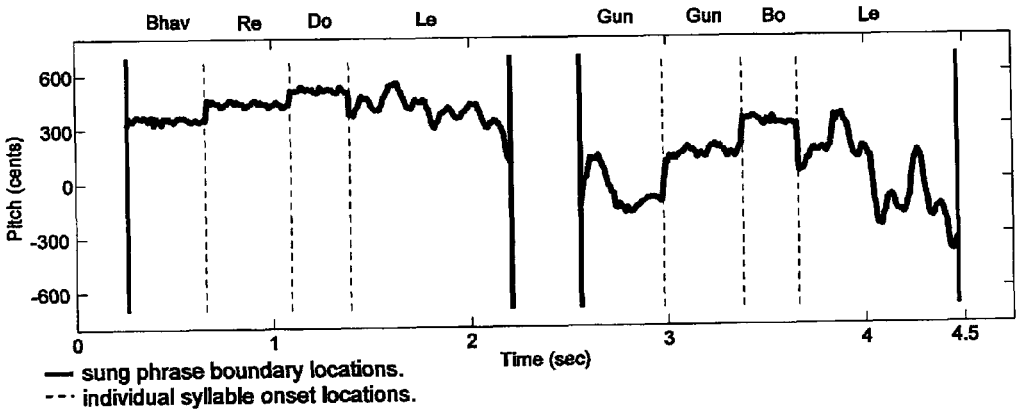

FIG. 3*b* is the corrected Pitch Contour Representation (PCR) of FIG. 3*a*.

Figure 4:
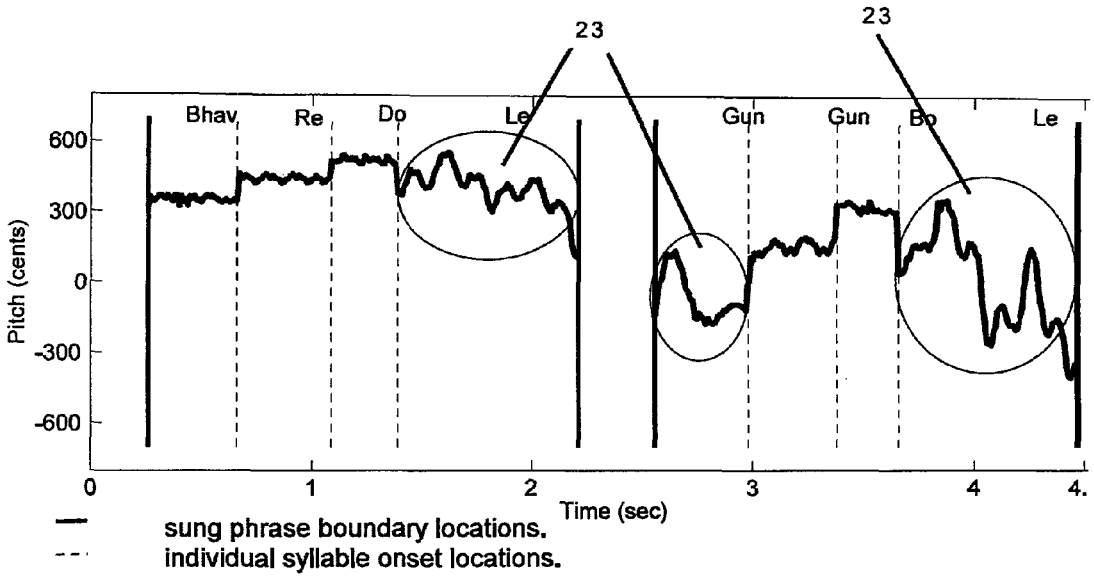

FIG. 4 is a Pitch Contour Representation (PCR) of a singing voice with the regions of greater musical expression therein being marked.

The block diagram of FIG. 1 of a system for scoring a singing voice includes a receiving means 1, a processor means 2, a user interface means 3, a storing means 4 and a display means 5. The processor means 2 interconnects all the other means through it in a known way, such as in computer systems.

The receiving means 1 comprises at least one well known hardware (with corresponding software(s), if required) such as CD/DVD reader 6, USB reader 7 for reading and receiving audio signals and/or their corresponding Pitch Contour Representations (PCR) from external data storage means such as a CD/DVD, USB. The receiving means is also adapted to receive the audio signals and/or their corresponding PCRs from mobile phones, internet, computer networks etc through their corresponding hardware (with corresponding software(s), if required. The receiving means is also adapted to receive audio signals directly from a singer through a mic 8 interfaced thereto through well known hardware circuitries such as an ADC 9 (analog to digital convertor). The receiving means may also be adapted to receive audio signals and/or their corresponding PCRs wirelessly. The above receiving means are interfaced with the processor means 2 in a known way, for example, as interfaced in computer systems, for transmitting the read/received data in the receiving means 1 to the processor means 2 for further processing. Generally, a song stored in an external disc sung by the original artist, or a corresponding PCR thereof, is to be taken as reference and the singer's singing voice is fed into the processor 2 through the mic 8 and ADC 9 for comparison with the reference within the processor means 2. Alternatively, there may be provided two ADCs 9 to receive two singers' voices, simultaneously or separately, for comparing with each other. Thus one voice acts as a reference. Similarly, there may also be provided two or more than two hardware for reading and receiving audio signals and/or their corresponding PCRs from an external data storage means and comparing them with each other.

The processor means 2 is essentially a processor comprising the following functional modules—a Pitch Contour Representation (PCR) module 10, time synchronization module 11, selection module 12, cross-correlation module 13, key matching module 14, rhythm matching module 15 and a scoring module 16. Each module is pre-programmed, based on a particular algorithm, to perform a designated function corresponding to its algorithm. The modules are configured/designed to communicate with each other and may either be an integral part of the processor 2 or dedicated devices such as a microcontroller chip or a device of the like embedded within the processor 2 and connected to each other through I/O buses. The processor 2 may also comprise other components typically required for functioning of a processor 2 such as RAM, BIOS, power supply unit, slots for receiving, interfacing with other external devices etc.

The display means 5, user interface means 3 and storage means are devices interfaced with the processor 2. Preferably, a synthesizer is also interfaced with the processor means 2.

The display means 5 is a display device such as a monitor (CRT, LCD, plasma etc) for displaying information to user to enable him to use the user interface means 3 for providing input to the processor 2 such as selecting/deselecting certain parameters of a module etc. The user interface means 3 comprises preferably of a graphical user interface displayed on the display means 5 and interfaced with commonly known interfacing device(s), such as a mouse or a trackball or a touch screen on the monitor.

The storage means may be internal or external forms of hard drives interfaced with the processor 2.

If PCR of an audio signal is received through the processor means 2, such is transmitted to the selection module 12. Else, the audio signal from the receiving means 1 is transmitted into the PCR module 10 of the processor 2 for determining the PCR thereof. The pitch contour representation (PCR) of an audio signal (essentially comprising music and audio data therein) is defined as a graph of the voice-pitch, in cents scale, of individual sung phrases plotted against time, further annotated with syllable onset locations. Pitch is a psychological percept and can be defined as a perceptual attribute that allows the ordering of sounds in a frequency-related scale from low to high. The physical correlate of pitch is the fundamental frequency (F0), which is defined as the inverse of the time period. The PCR module 10 is pre-programmed to calculate the PCR of the audio signals based on known algorithms, such as, sinusoid identification by main-lobe matching, the Two-Way Mismatch (TWM) algorithm, Dynamic Programming (DP) based optimal path-finding, energy-based voicing detection, similarity-matrix based audio novelty detection and sub-band energy based syllable onset detection. First the audio signal is processed to detect the frequencies and amplitudes of sinusoidal components, at time-instants spaced 10 ms apart, using a window main-lobe matching algorithm. These are then input into the TWM Pitch Detection Algorithm (PDA), which falls under the category of harmonic matching PDAs that are based on the frequency domain matching of a measured spectrum with an ideal harmonic spectrum. The output of the TWM algorithm is a time-sequence of multiple pitch candidates and associated salience values. These are input into the DP-based path finding algorithm which finds the final pitch trajectory, in Hz scale, through this pitch candidate v/s time space. The final pitch trajectory and sinusoid frequencies and amplitudes are input into the energy-based voicing detector, which detects individual sung phrases by computing an energy vector as the total energy of the detected harmonics, which are sinusoids at multiples of the pitch frequency, of the output pitch values for each instant of time, and comparing the elements of the energy vector to a predetermined threshold value. The energy vector is input into the boundary detector which groups the voicing detection results over boundaries of sung phrases detected using a similarity matrix-based audio novelty detector. The final pitch trajectory and sinusoid frequencies and amplitudes are also input into the syllabic onset detector which detects syllabic onset locations by looking for strong peaks in a detection function. The detection function is computed as the rate of change of harmonic energy in a particular sub-band (640 to 2800 Hz). The pitch values in the PCR $f_{Hz}$ are then converted to the semi-tone (cents) scale $f_{cents}$ using a known formula given as $$f_{cents} = 1200 * \log2\left(\frac{f_{Hz}}{F_{ref}}\right),$$

where $F_{ref}$ is a reference frequency. The value of $F_{ref}$ can be chosen to be a fixed frequency for both reference and user PCRs in the case of singing with karaoke accompaniment which is in the same key as the original song. If such karaoke music is not available to the user, the values of $F_{ref}$ for the reference and user PCRs are set to their individual geometric means. This is required for the cross-correlation and key matching scores to be transposition invariant.

Upon determination of the PCR of the input audio signal, such is displayed, as shown in FIG. 3*a*, on the display means 5. However, such a PCR may be erroneous 22 owing to the fact that the PCR modules 10 are prone to error, especially the PCR of polyphonic audio signal. Such PCR(s) may be verified, however, optionally. The verification of the PCR may be done by audio and/or visual feedback. For audio verification, the PCR is first converted to its corresponding audio signal by means of the synthesizer interfaced with the processor 2. The audio signal from the synthesizer is heard by the user to decide manually whether the audio signal of the PCR is the same as the original audio signal input into the receiving means 1. For visual verification the PCR, a verification module 21 is invoked. The verification module 21 may be an integral part of the processor 2 or an external processor interfaced with the processor 2 or a dedicated device such as a microcontroller chip or a device of the like embedded within the processor 2 or an external processor and comprising an algorithm pre-programmed to verify the PCR vis-à-vis the original audio signal. The algorithm therein involves superimposition of the PCR on a spectrogram representation of the original audio signal. Such is also displayed on the display means 5. The spectrogram is a known representation that displays the time-varying frequency content of an audio signal. For verification, the PCR should show the same trends as any of the voice-pitch harmonic trajectories (clearly visible in the spectrogram). If any or both of the verification strategies are not satisfied, user interactive controls of the user interface means 3 are invoked to change the parameters of the algorithm within the PCR module 10 to re-determine the PCR of the original audio signal. Typical parameters that can be tuned by a user in the PCR module 10 are the pitch search range, frame-length, lower-octave bias and melodic smoothness tolerance. For example, in FIG. 3*a*, the PCR of the singer (female) shows lower-octave errors 22 in some parts. An octave error 22 is said to occur when the output pitch values are double or half of the correct pitch values. The octave errors in FIG. 3*a* can be corrected by using a higher pitch search range and decreasing the frame-length and lower-octave bias. The corrected PCR is shown in FIG. 3*b*. The above process is repeated iteratively to finalize the PCR.

Thereafter, the selection module 12 is invoked. The selection module 12 is pre-programmed to manually and/or automatically select or mark a region(s) of the finalized PCR. Usually, such selected regions(s) corresponds to regions of greater musical expressivity in the song and are characterized by the presence of prominent pitch inflexions and modulations, which may be indicative of western musical ornaments, such as vibrato and portamento, and also non-western musical ornaments, such as gamak and meend for Indian music. The manual selection is facilitated through the user interactive controls in the user interface means 3 by observing prominent inflexions and modulations in PCR on the display means 5 and selecting portion(s) of the PCR comprising such prominent inflexions and modulations. Automatic selection is based on pre-determined parameters fed in the musical expression detection algorithm of the selection module 12. The musical expression detection algorithm involves examining the parameters of the stylized PCR. Stylization refers to the representation of a continuous PCR by a sequence of straight-line elements without affecting the perceptually relevant properties of the PCR. First critical points in the PCR of individual sung syllables are determined by fitting straight lines to iteratively extended segments of the PCR within these segments. Points on the PCR that fall outside a perceptual band around such straight lines are marked as critical points. If intra-syllabic segments with at least one critical point within have straight line slopes greater than a predetermined threshold, then these regions are selected as regions of greater musical expression.

Upon finalizing the above selection(s), the PCR with the selected/marked portion(s) therein is/are saved as reference PCR in the storage means.

Subsequently, an audio signal of a user with an objective of scoring his/her voice against the reference audio signal is input into the processor means 2 through one of the receiving means 1 described above. A corresponding user PCR thereof is determined. Such is then time-synchronized with the reference PCR for maximizing the cross-correlation (described below) between sung-phrase locations in the reference and user PCRs. Time synchronization is carried out by means of the time synchronization module 11 pre-programmed to time synchronize two PCRs based on algorithms such as time-scaling and time-shifting. The time-scaling algorithm stretches or compresses the user PCR such that the durations of corresponding individual sung phrases in the reference and user PCR are the same. The time-shift algorithm shifts the user PCR in time by a relative delay value required to achieve maximum co-incidence between the sung phrases of the reference and user PCRs. Subsequently, portions of the user PCR corresponding to the selected regions in the finalized PCR is/are selected/marked by the selection module 12. It is to be noted that the selection process in the user PCR is different than that in the reference PCR. Such is pre-programmed within the selection module 12. Thus the selection module 12 may be configured to provide an option to the user, prior to the selection, in respect of the process of selection to be used. Verification of the PCR so determined prior to the selection of regions therein may be conducted through one of the means as described above. Thereafter, for determining the singing score, the corresponding selected and not selected portions of the user and reference PCRs are compared with each other as described below.

The corresponding selected regions of the reference and user PCRs are cross-correlated with each other through the cross-correlation module 13. The cross-correlation module 13 is pre-programmed to perform time-warped cross-correlation of the selected portions of the reference and user PCRs in a known way such as by Dynamic Time Warping (DTW). DTW is a well-known distance measure for time series, allowing similar shaped PCRs to match even if they are non-linearly warped in the time axis. This matching is achieved by minimizing a cumulative distance measure consisting of local distances between aligned samples. This distance measure SCorr is given as $$SCorr = \frac{\sum_{k=1}^{K} (q'(k) - \overline{q'})(r'(k) - \overline{r'})}{\sigma(q')\sigma(r')},$$

where q' and r' are the time-warped and duration-matched versions of the user and reference PCRs of corresponding individual selected regions, K is the total number of pitch values in a selected PCR region, $\overline{q'}$ and $\sigma(q')$ are mean and standard deviation of q' respectively and the same notations apply to r'. Known global constraints, such as the Sakoe-Chiba band, are imposed on the warping path so as to limit the extent to which the warping path can stray from the diagonal of the global distance matrix and thus prevent pathological warping. Finally, an overall cross-correlation score is computed as the sum of the DTW distances estimated for each of the selected regions. The algorithm for such cross-correlation may be stored within the processor 2 or in a microcontroller within the processor 2. A cross-correlation score is outputted from the cross-correlation module 13.

Simultaneously, the corresponding non-selected portions of the reference and user PCRs are compared to each other by the key matching 14 and rhythm matching modules 15 and corresponding score is outputted therefrom. The key 14 and rhythm matching 15 modules employ the well known key and rhythm matching algorithms such as pitch and beat histogram matching respectively. For key matching, the PCRs of the non-selected regions are first passed through a low-pass filter of bandwidth 20 Hz in order to suppress small, involuntary fluctuations in pitch, and then down-sampled by a factor of 2. Next 5 pitch histograms are computed from the reference and user PCRs. A pitch histogram contains information about pitch values and durations without regard to the time sequence information. A half-semitone bin width is used. Next, a linear correlation measure is computed to indicate the extent of match between the reference and user pitch histograms as shown below:

$$PCorr[\text{n_oct}] = \frac{1}{K}\sum_{K=0}^{K-1} q(k)r(\text{n_oct} + k),$$

where K is the total number of histogram bins, and q and r are the user and reference pitch histograms respectively. The above correlation value, PCorr, is calculated for various n_oct i.e. octave shifts of 0, +1 and −1 octave. This last step is necessary to compensate for the possibility of the singer and the reference song appearing in the same key but octave apart e.g. female singer singing a low pitched male reference song. That value of n_oct that maximizes the correlation is retained, and the corresponding correlation value is called the key matching score.

For rhythm matching, first inter-onset-interval (IOI) histograms are computed by considering all pairs of syllable onsets across the user and reference PCRs respectively. The range of bins used in the IOI histograms is from 50 to 180 beats-per-minute (bpm). Next a linear correlation measure is computed to indicate the extent of match between the reference and user IOI histograms as shown below $$RCorr = \frac{1}{K}\sum_{k=0}^{K-1} q(k)r(k),$$

where K is the total number of histogram bins and q and r are the user and reference IOI histograms respectively. RCorr is the rhythm match score. If the bpm value for the reference has been provided in the metadata of the reference singing then the rhythm score can also be computed as the deviation of the user bpm from the reference bpm. The user bpm is computed as that which maximizes the normalized energy of the comb filter applied to the user IOI histogram.

The cross-correlation, key matching and rhythm matching scores are fed into the scoring module 16 which based on a pre-determined weighting of each of the cross-correlation, key matching and rhythm matching score outputs a combined score indicative of the singing score of the user's singing voice. The scoring module 16 is pre-programmed based on algorithms such as a simple weighted average function_to output the above.

Upon determination of the singing score, such is displayed on the display means 5, preferably along with the individual cross-correlation, key matching and rhythm matching scores. The scores may also be saved on the storing means 4 for future reference.

Preferably and optionally, the above system comprises of a music extraction module 17 and an audio playing module 18. The music extraction module 17 may either be an integral part of the processor 2 or a dedicated device such as a microcontroller chip or a device of the like embedded within the processor 2 and pre-programmed to extract music component from an audio signal based on well known algorithms such as vocal suppression using sinusoidal modeling. In the algorithm, the frequencies, amplitudes and phases of prominent sinusoids are detected for all analysis time instants using a known window main-lobe matching technique. Next all local sinusoids in the vicinity of expected voice harmonics, computed from the reference PCR, are erased. From the remaining sinusoids, a sinusoidal model is computed using known algorithms such as the MQ or SMS algorithms. The synthesis of the computed sinusoidal model results in the music audio component of the reference signal.

The audio playing module 18 is interfaced to speakers 19 provided within or externally to the system to output the above music component of the reference signal. The extracting means, at any time during the above mentioned processes, preferably before the determination of the PCR of the reference audio signal, if the reference audio signal is polyphonic, extracts the music component from the reference audio signal and saves it within the storing means 4. Thereafter, while the user is singing the song and his voice is being fed into the system through the mic 8 into the ADC 9, the saved music component of the reference audio signal is played by the audio playing means for providing accompanying instrumental background music to the user to contribute to the singing environment.

Example

A popular song 'Kuhoo kuhoo bole koyaliya' of a renowned artist 'Lata Mangeshkar' stored in a CD/DVD/USB stick is inserted into the corresponding drive—CD drive/DVD drive/USB slot in the receiving means 1 block of the system which is interfaced with the processor 2. The PCR module 10 of the processor 2 receives the audio data comprising the polyphonic audio signal and determines a corresponding PCR thereof, a part of which is shown in FIG. 3*a*. However, if a PCR corresponding to the song is received, the PCR determination is bypassed. Optionally, the determined PCR is verified. To verify the PCR, a visual and/or audio feedback method is used to judge the exactness of the audio signal with that of the original audio signal stored in the CD/DVD/USB. If the user concludes that the exactness is unsatisfactory, the PCR of the original audio signals is re-determined after tweaking the PCR determining parameters such as the pitch search range, frame-length, lower-octave bias and melodic smoothness tolerance, through the user interface. Such is iteratively performed until a PCR of the original audio signal is finalized, as shown in FIG. 3*b*. Thereafter, by means of the selection module 12, regions of greater musical expressivity of the so finalized PCR are determined and correspondingly selected/marked 23 on the PCR as shown in FIG. 4. Such determination is either manual and/or automatic as described above. Subsequently, the PCR with selected/marked portions therein, is saved as reference PCR in the storage means.

Now, a competitor user feeds his/her voice in the system through a mic 8 interfaced with an ADC 9 provided in the receiving means 1 block of the system. The digital voice of the user is transmitted to the PCR module 10 and their corresponding user PCR is determined. Thereafter, the user PCR is time synchronized with the reference PCR through the time synchronizing module. Subsequently, portions of the so time synchronized user PCR are selected/marked corresponding to the regions selected in the reference PCR through the selection module 12.

Subsequently, the corresponding selected portions of the user and reference PCRs are cross-correlated with time-warping with each other as described above by the cross-correlation module 13 of the processor 2. A corresponding cross-correlation score is outputted and fed to the scoring module 16. Simultaneously, the unselected portions of the user and reference PCRs are key matched and rhythm matched separately by their respective key matching 14 and rhythm matching 15 modules in the processor 2. A corresponding key matching and rhythm matching score is outputted and fed to the scoring module 16.

Thereafter, the scoring module 16 which is pre-programmed to provide a specific weighting to each of the above scores calculates a combined score. For example, if the weighting to the cross-correlation, key matching and rhythm matching scores are 60%, 20% and 20% respectively, and their corresponding actual scores are 5, 8 and 8, the singing score would be 6.2 out of 10. Such is displayed on the display means 5. Preferably, each of the individual scores is also displayed on the display means 5.

FIG. 2 is a flow chart depicting the steps involved in a method for scoring a singing voice. In the method, a singing reference audio signal 30 or its corresponding Pitch Contour Representation (PCR) 31 and a singing user audio signal 32 or its corresponding PCR 33 are received. If the singing reference 30 and user audio signals 32 are received, their corresponding PCRs 35 & 36 are determined 34 based on well known algorithms such as sinusoid identification by main-lobe matching, Dynamic Programming (DP) based optimal path-finding, energy-based voicing detection, similarity-matrix based audio novelty detection and sub-band energy based syllable onset detection. First the audio signal is processed to detect the frequencies and amplitudes of sinusoidal components, at time-instants spaced 10 ms apart, using a window main-lobe matching algorithm. These are then input into the TWM Pitch Detection Algorithm (PDA), which falls under the category of harmonic matching PDAs that are based on the frequency domain matching of a measured spectrum with an ideal harmonic spectrum. The output of the TWM algorithm is a time-sequence of multiple pitch candidates and associated salience values. These are input into the DP-based path finding algorithm which finds the final pitch trajectory, in Hz scale, through this pitch candidate v/s time space. The final pitch trajectory and sinusoid frequencies and amplitudes are input into the energy-based voicing detector, which detects individual sung phrases by computing an energy vector as the total energy of the detected harmonics, which are sinusoids at multiples of the pitch frequency, of the output pitch values for each instant of time and comparing the elements of the energy vector to a predetermined threshold value. The energy vector is input into the boundary detector which groups the voicing detection results over boundaries of sung phrases detected using a similarity matrix-based audio novelty detector. The final pitch trajectory and sinusoid frequencies and amplitudes are also input into the syllabic onset detector which detects syllabic onset locations by looking for strong peaks in a detection function. The detection function is computed as the rate of change of harmonic energy in a particular sub-band (640 to 2800 Hz)

The pitch values in PCR $f_{Hz}$ are then converted to the semi-tone (cents) scale $f_{cents}$ using $$f_{cents} = 1200 * \log2\left(\frac{f_{HZ}}{F_{ref}}\right),$$

where $F_{ref}$ is a reference frequency. The value of $F_{ref}$ can be chosen to be a fixed frequency for both reference and user PCRs in the case of singing with karaoke accompaniment which is in the same key as the original song. If such Karaoke music is not available to the user, the value of $F_{ref}$ for the reference and user PCRs is set to their individual geometric means. This is required for the cross-correlation and key matching scores to be transposition invariant. Optionally, to verify 37 the PCRs of the reference and/or user audio signals 31 & 33 or 35 & 36, a corresponding audio signal thereof may be determined 38 and heard by a user 39 to determine 40 its exactness with the original audio signal. Verification may also be done by super-imposing 41 the PCR of the audio signal on a spectrogram of the audio signal and visually compare 42 the trends in PCR with that of the voice-pitch harmonic trajectories visible in the spectrogram. If the above determined exactness/comparison so determined is unsatisfactory, the PCR is re-determined by changing/tweaking 43 the parameters in the algorithm for determining the PCR such as the pitch search range, frame-length, lower-octave bias and melodic smoothness tolerance. Subsequently, regions of greater musical expression of the PCR of the reference audio signal are selected 43 either manually or automatically. Such regions are characterized by the presence of prominent pitch inflexions and modulations, which may be indicative of western musical ornaments, such as vibrato and portamento, and also non-western musical ornaments, such as gamak and meend for Indian music. Manual selection is based on visual inspection of the PCR wherein the segment of the PCR comprising prominent inflexions and modulations is construed to be as the regions of greater musical expression. Automatic selection is based on a musical expression detection algorithm, which examines the parameters of the stylized PCR. Stylization refers to the representation of a continuous PCR by a sequence of straight-line elements without affecting the perceptually relevant properties of the PCR. First critical points in the PCR of individual sung syllables are determined by fitting straight lines to iteratively extended segments of the PCR within these segments. Points on the PCR that fall outside a perceptual band around such straight lines are marked as critical points. If intra-syllabic segments with at least one critical point within have straight line slopes greater than a predetermined threshold, then these regions are selected as regions of greater musical expression. Optionally, the PCR of the reference audio signal with regions of greater musical expression selected therein may be saved 44 for future use. In respect of the PCR of the user audio signal, it is first time synchronized 45 with the PCR of the reference audio signal and regions corresponding to the selected regions in the PCR of the reference audio signal are also selected 46 in the PCR of the reference user audio signal. The time-synchronization 45 is done for maximizing the cross-correlation (described below) between sung-phrase locations in the PCRs of the reference and user audio signals. The time synchronization, is based on algorithms such as time-scaling and time-shifting. The time-scaling algorithm stretches or compresses the user PCR such that the durations of corresponding individual sung phrases in the reference and user PCR are the same. The time-shift algorithm shifts; the user PCR in time by a relative delay value required to achieve maximum co-incidence between the sung phrases of the reference and user PCRs. Subsequently, the corresponding selected segments of the PCRs of the reference and/or user audio signals are subjected to time-warped cross-correlation 47 and a corresponding cross-correlation score determined 48. Such a cross-correlation 47 is based on well known algorithm such as Dynamic Time Warping (DTW). DTW is a known distance measure for time series, allowing similar shaped PCRs to match even if they are non-linearly warped in the time axis. This matching is achieved by minimizing a cumulative distance measure consisting of local distances between aligned samples. This distance measure SCorr is given as $$SCorr = \frac{\sum_{k=1}^{K}\left(q'(k)-\overline{q'}\right)\left(r'(k)-\overline{r'}\right)}{\sigma(q')\sigma(r')},$$

where q' and r' are the time-warped duration-matched versions of the user and reference PCRs of individual selected regions, K is the total number of pitch values in a selected PCR region, $\overline{q'}$ and $\sigma(q')$ are mean and standard deviation of q' respectively and the same notations apply to r'. Known global constraints, such as the Sakoe-Chiba band, are imposed on the warping path so as to limit the extent to which the warping path can stray from the diagonal of the global distance matrix and thus prevent pathological warping. Finally, an overall cross-correlation score 47 is computed as the sum of the DTW distances estimated for each of the selected regions. Simultaneously, the remaining corresponding non-selected portions of the PCRs of the reference and user audio signals are key matched 49 and rhythm matched 50 through well known key matching and rhythm matching algorithms such as pitch and beat histogram matching respectively. For key matching, the PCRs of the non-selected regions are first passed through a low-pass filter of bandwidth 20 Hz in order to suppress small, involuntary fluctuations in pitch, and then downsampled by a factor of 2. Next pitch histograms are computed from the PCRs of the reference and user audio signals. A pitch histogram contains information about pitch values and durations without regard to the time sequence information. A half-semitone bin width is used. Next a linear correlation measure is computed to indicate the extent of match between the reference and user pitch histograms as shown below:

$$PCorr[\text{n_oct}] = \frac{1}{K}\sum_{k=0}^{K-1} q(k)r(\text{n_oct}+k),$$

where K is the total number of histogram bins, and "q" and "r" are the user and reference pitch histograms respectively. The above correlation value, PCorr, is calculated for various "n_oct" i.e. octave shifts of 0, +1 octave and −1 octave. This last step is necessary to compensate for the possibility of the singer and the reference song appearing in the same key but octave apart e.g. female singer singing a low pitched male voice reference song. That value of n_oct that maximizes the correlation is retained, and the corresponding correlation value is called the key matching score 51.

For rhythm matching, first inter-onset-interval (IOI) histograms are computed by considering all pairs of onsets across the user and reference PCRs respectively. The range of bins used in the IOI histograms is from 50 to 180 beats-per-minute (bpm). Next a linear correlation measure is computed to indicate the extent of match between the reference and user IOI histograms as shown below $$RCorr = \frac{1}{K}\sum_{k=0}^{K-1} q(k)r(k),$$

where K is the total number of histogram bins and "q" and "r" are the user and reference KM histograms respectively. RCorr is the rhythm match score 43. If the bpm value fo the reference has been provided in the metadata of the reference singing then the rhythm score can also be computed as the deviation of the user bpm from the reference bpm. The user bpm is computed as that which maximizes the normalized energy of the comb filter applied to the user IOI histogram. Thereafter, a combined singing score 53 is determined based on a predetermined weighting of the cross-correlation 48, key matching 51 and rhythm matching 52 scores.

Preferably and optionally, the musical component from the singing reference audio signal is extracted 54 therefrom and played 55 in the background while a user is singing for the purpose of scoring with respect to the reference singing voice. Such extraction 54 is based on well known algorithms such as vocal suppression using sinusoidal modeling. In the algorithm, the frequencies, amplitudes and phases of prominent sinusoids are detected for all analysis time instants using a known window main-lobe matching technique. Next all local sinusoids in the vicinity of expected voice harmonics, computed from the reference PCR, are erased. From the remaining sinusoids, a sinusoidal model is computed using known algorithms such as the MQ or SMS algorithms. The synthesis of the computed sinusoidal model results in the music audio component of the reference signal.

According to the invention, a superior singing scoring strategy is provided that takes into account the inter-note and intra-note pitch variations in a singing voice which are musically important and indicative of greater singing expressiveness. The inter-note and intra-note pitch variations are fully captured in a PCR of an audio signal. Thus, by comparing the respective PCRs of the user and reference audio signals, their inter-note and intra-note pitch variations are compared and the resultant score is indicative of a quantum of the singing expressiveness of the user's singing voice. Further by applying cross-correlation to the determined regions of greater musical expression of the PCR and key matching and rhythm matching to the other segments of the PCR, the comparison between the user and reference singing voice is rendered more fine and quantum of singing expressiveness indicative therein is further enhanced.

Although the invention has been described with reference to a specific embodiment, this description is not meant to be construed in a limiting sense. Various modifications of the disclosed embodiment, as well as alternate embodiments of the invention, will become apparent to persons skilled in the art upon reference to the description of the invention. It is therefore contemplated that such modifications can be made without departing from the scope of the invention as defined in the appended claims.

We claim:

1. A system for scoring a singing voice, the system comprising:

a. a receiving means for receiving a singing reference audio signal or a pitch contour representation (PCR) thereof and a singing user audio signal or a pitch contour representation (PCR) thereof wherein the PCR is a graph of voice-pitch in said audio signals plotted against time, the graph being annotated with syllable onset locations;

b. a processor means connected to the receiving means and comprising i. a pitch contour representation (PCR) module for determining a PCR of the singing reference audio signal and singing user audio signal;

ii. a time synchronization module for time synchronizing the reference and user PCRs;

iii. a selection module for a. selecting a segment of the reference PCR having musical expressivity which being determined on the basis of presence of prominent inflexions and modulations in said reference PCR;

b. selecting a segment of the time-synchronized user PCR corresponding to the segment selected in reference PCR iv. a cross-correlation module for performing time-warped cross-correlation of said selected segments of reference and user PCRs and outputting a cross-correlation score;

v. a key matching module for key matching the corresponding unselected segments of the reference and user PCRs by filtering said unselected segments through a low-pass filter for suppressing small and involuntary fluctuations in pitch, generating a histogram of said filtered unselected segments and performing a linear correlation between said histograms for determining a key matching score;

vi. a rhythm matching module for rhythm matching the reference and user PCRs by generating an inter-onset-interval (IOI) histogram from syllable onset locations of the respective PCRs and performing a linear correlation between said IOI histograms for determining a rhythm matching score;

vii. a scoring module for determining a singing score for singing user audio signal based on a combination of a pre-determined weightage of the cross-correlation, key matching and rhythm matching scores;

c. a user interface means connected to the processor means for changing at least one module parameter within at least one module;

d. a storing means connected to the processor means; and e. a display means connected to the processor means for displaying the PCR and singing score.

2. The system for scoring a singing voice as claimed in claim 1, wherein the processor means comprises of an extracting module for extracting musical audio signals from a polyphonic audio signal.

3. The system for scoring a singing voice as claimed in claim 1, wherein the processor means comprises of an audio playing module interfaced with a speaker for playing the audio signal.

4. The system for scoring a singing voice as claimed in claim 1, wherein the receiving means is a disk reader such a CD (Compact Disc) reader or a DVD-reader.

5. The system for scoring a singing voice as claimed in claim 1, wherein the receiving means is an Analog to Digitial convertor (ADC) connected to a microphone.

6. The system for scoring a singing voice as claimed in claim 1, wherein the receiving means is adapted to receive audio signals and PCR thereof through interne, networks and mobile.

7. The system for scoring a singing voice as claimed in claim 1, wherein the PCR from the PCR module is adapted to be outputted to a synthesizer for generating a corresponding audio signal thereof.

8. The system for scoring a singing voice as claimed in claim 1, wherein the PCR from the PCR module is verified by means of a verification module interfaced with the display means or an external processor interfaced with the processor means and the display means and pre-programmed to superimpose the PCR of an audio signal on a spectrogram representation of the audio signal.

9. The system for scoring a singing voice as claimed in claim 1, wherein the user interface means comprises of a graphical user interface displayed on the display means and connected to interfacing devices such as a mouse or a trackball or a touch screen on the display means through the processor means.

10. The system for scoring a singing voice as claimed in claim 1, wherein the selection module is adapted to manually select a segment(s) of the reference PCR displayed on the display means through the user interface means.

11. The system for scoring a singing voice as claimed in claim 1, wherein the selection module is pre-programmed to automatically select a segment(s) of the reference PCR.

12. The system for scoring a singing voice as claimed in claim 1, wherein the storing means stores the audio signals, the PCRs of the audio signals, and PCRs of the audio signals with segments selected therein.

13. A method for scoring a singing voice, the method comprising the steps of:

receiving a singing reference audio signal or a pitch contour representation (PCR) thereof and a singing user audio signal or a pitch contour representation (PCR) thereof wherein the PCR is a graph of voice-pitch in said audio signals plotted against time, the graph being annotated with syllable onset locations;

determining a pitch contour representation (PCR) of the singing reference audio signal and the singing user audio signal if their respective PCR not being received;

selecting a segment of the reference PCRs having musical expressivity which being determined on the basis of presence of prominent inflexions and modulations in said reference PCR;

time-synchronizing the PCRs of the singing reference and user audio signals;

selecting a segment in the user PCR corresponding to the segment selected in the reference PCR;

performing time-warped cross-correlation of the selected segments of the reference and user PCRs and outputting a cross-correlation score;

key matching the corresponding unselected segments of the reference and user PCRs by filtering said selected segments through a low-pass filter for suppressing small and involuntary fluctuations in pitch, generating a histogram of said filtered unselected segments and performing a linear correlation between said histograms for determining a key matching score;

rhythm matching the reference and user PCRs by generating an inter-onset-interval (IOI) histogram from the syllable onset locations of the respective PCRs and performing a linear correlation between said IOI histograms for determining a rhythm matching score;

determining a singing score based on a combination of a pre-determined weightage of the cross-correlation, key matching and rhythm matching scores.

14. The method for scoring a singing voice as claimed in claim 13, wherein the reference PCR is finalized after verifying thereof.

15. The method for scoring a singing voice as claimed in claim 14, wherein the reference PCR is verified by a. generating a corresponding audio signal thereof; and b. hearing the corresponding audio signal to determine its exactness with the singing reference audio signal.

16. The method for scoring a singing voice as claimed in claim 14, wherein the reference PCR is verified by means of an algorithm programmed to super-impose the corresponding PCR on a spectrogram representation of the singing corresponding audio signal and visually verifying whether the PCR shows the same trends as any of the voice-pitch harmonic trajectories visible in the spectrogram.

17. The method for scoring a singing voice as claimed in claim 14, wherein based on the result of the verification, parameters for determining the reference PCR are modified for re-determining the reference PCR.

18. The method for scoring a singing voice as claimed in claim 13, wherein said selection is manual and based on visual inspection of the PCR.

19. The method for scoring a singing voice as claimed in claim 13, wherein said selection is automatic by means of an algorithm.

20. The method for scoring a singing voice as claimed in claim 13, wherein a musical component from the singing reference audio signal, if any, is extracted and played as background instrumental music while a user singing a song for scoring the singing user audio signal against the reference singing audio signal.

* * * * *